US006066055A

United States Patent [19]

Nishino

[11] Patent Number: 6,066,055

[45] Date of Patent: May 23, 2000

[54] GOLF BALL

[75] Inventor: Takumi Nishino, Akashi, Japan

[73] Assignee: Sumitomo Rubber Industries, Ltd., Hyogo, Japan

[21] Appl. No.: 09/337,732

[22] Filed: Jun. 22, 1999

[30] Foreign Application Priority Data

Jul. 22, 1998 [JP] Japan ..... 10-206792
May 6, 1999 [JP] Japan ..... 11-125499

[51] Int. Cl.[7] ..... A63B 37/12; A63B 37/14

[52] U.S. Cl. ..... 473/384; 473/378

[58] Field of Search ..... 473/378–384

[56] References Cited

U.S. PATENT DOCUMENTS

| | | | |
|---|---|---|---|
| 4,744,564 | 5/1988 | Yamada . | |
| 5,072,945 | 12/1991 | Oka | 273/232 |
| 5,090,705 | 2/1992 | Oka | 273/232 |
| 5,156,404 | 10/1992 | Oka | 273/232 |
| 5,503,397 | 4/1996 | Molitor | 273/230 |
| 5,588,924 | 12/1996 | Sullivan | 473/377 |
| 5,766,098 | 6/1998 | Molitor | 473/377 |
| 5,902,193 | 5/1999 | Shimosaka | 473/384 |
| 5,906,551 | 5/1999 | Kasashima | 473/384 |
| 5,908,359 | 6/1999 | Shimosaka | 473/364 |

FOREIGN PATENT DOCUMENTS

B2-2569515 10/1996 Japan .

*Primary Examiner*—Lee Young
*Assistant Examiner*—Paul Kim

[57] ABSTRACT

A golf ball formed with half metal molds having stable flying ability without dispersion, regardless of hitting point on surface of the ball.

A parting line is latitude 0°, two pole portions are latitude 90°, an area of which latitude is 0° to 17° is a parting line vicinity, an area of which latitude is more than 17° and less than 62° is a shoulder portion, an area of which latitude is 62° to 90 ° is a pole vicinity. And, when X represents total volume of dimples which belong to the parting line vicinity, Y represents total volume of dimples which belong to the pole vicinity, and Z represents total volume of dimples which belong to the shoulder portion, X/Z is set to be 0.58 to 0.72, Y/Z is set to be 0.22 to 0.30, and Y/X is set to be 0.35 to 0.48.

4 Claims, 4 Drawing Sheets

GOLF BALL

BACKGROUND OF THE INVENTION

1. Field of the Invention

This invention relates to a golf ball formed with a pair of half metal molds.

2. Description of the Related Art

A golf ball formed with a pair of half metal molds is made as that a wound string core or a solid core is covered with two semispherical shells and heated, or a cover is injection-molded to be spherical, and then, flash along a parting line, corresponding to a contact face of the metal molds, is cut and removed.

A golf ball is required to have similar flying characteristics when hitted in any direction, in other words, required to have no aerodynamic anisotropy. However, in the golf ball made as described above, dimple effect near the parting line is weakened for a problem that dimples can not be disposed on the parting line corresponding to a contact face of the metal mold, and another problem that dimples near the parting line are ground away when the flash on the parting line is cut, aerodynamic anisotropy becomes conspicuous, and difference is generated in flying ability of the ball by changing hitting point of the ball.

The difference of the flying ability is concretely as follows. When the golf ball is hit as that an axis $L_2$ going through pole portions 3 is a rotational axis of back spin (this is occasionally called seam-hitting below) as shown in FIG. 6, trajectory of the ball tends to become lower and carry of the ball tends to become shorter in comparison with that of the other case in which the golf ball is hit as an axis $L_1$ going through the parting line is a rotational axis of back spin (this is occasionally called pole-hitting below) as shown in FIG. 5.

Conventionally, a golf ball in which only dimples near a parting line are deeper than dimples disposed on the other parts of the ball to eliminate dispersion of trajectory and flying distance generated by difference of hitting point, is disclosed by U.S. Pat. No. 4,144,564, etc.

Although the trajectory in seam-hitting rises and comes close to the trajectory in pole-hitting by arranging only the dimples near the parting line to be deep as described above, the trajectory in seam-hitting is still lower than the trajectory in pole-hitting, the aerodynamic anisotropy of the ball can not be solved, and the dispersion of trajectory and flying distance is still generated.

It is therefore an object of the present invention to provide a golf ball with which the problems described above are solved, the aerodynamic anisotropy vanishes, and the flying ability becomes stable regardless of position of hitting point.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
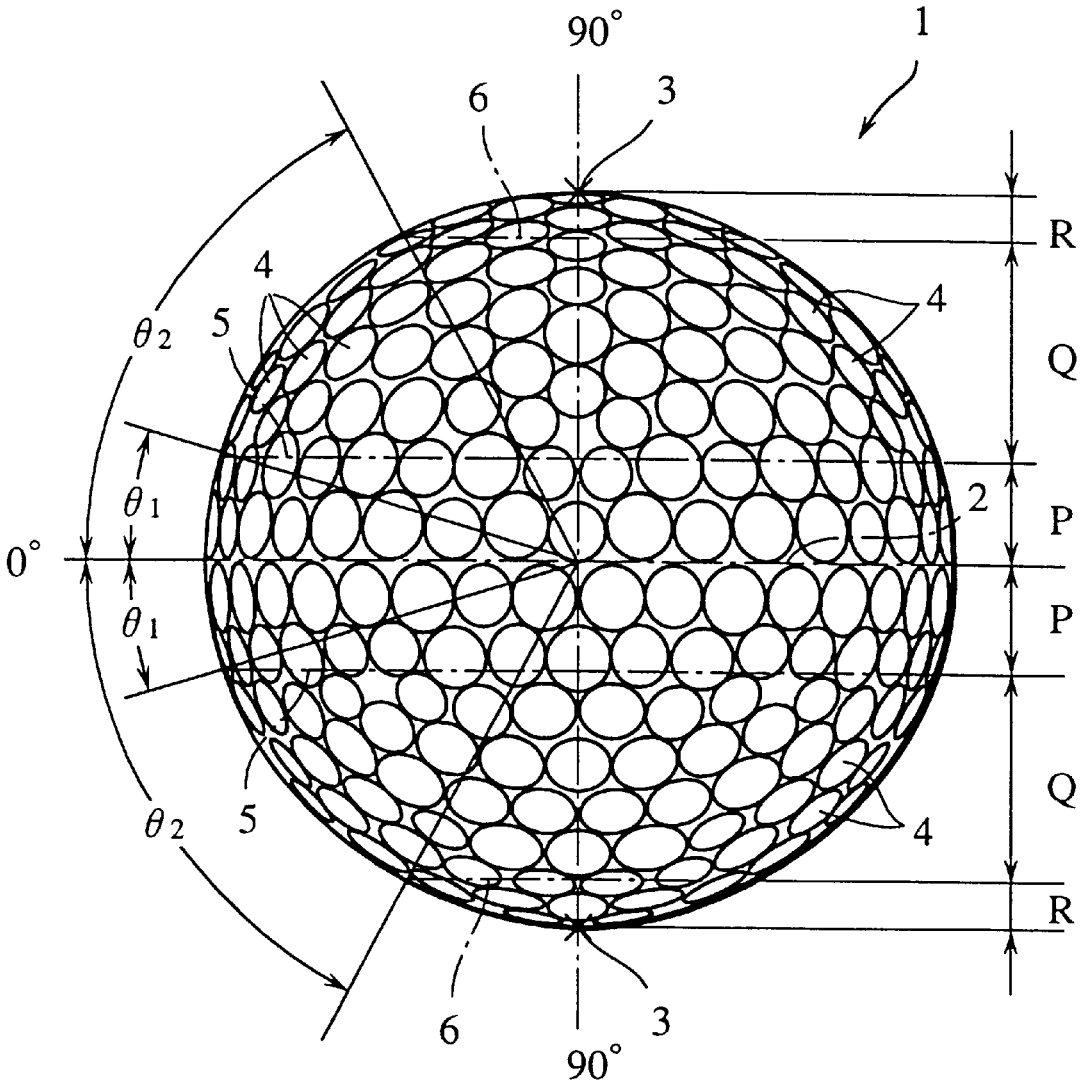
FIG. 1 is a front view showing a preferred embodiment of the present invention.
Figure 2:
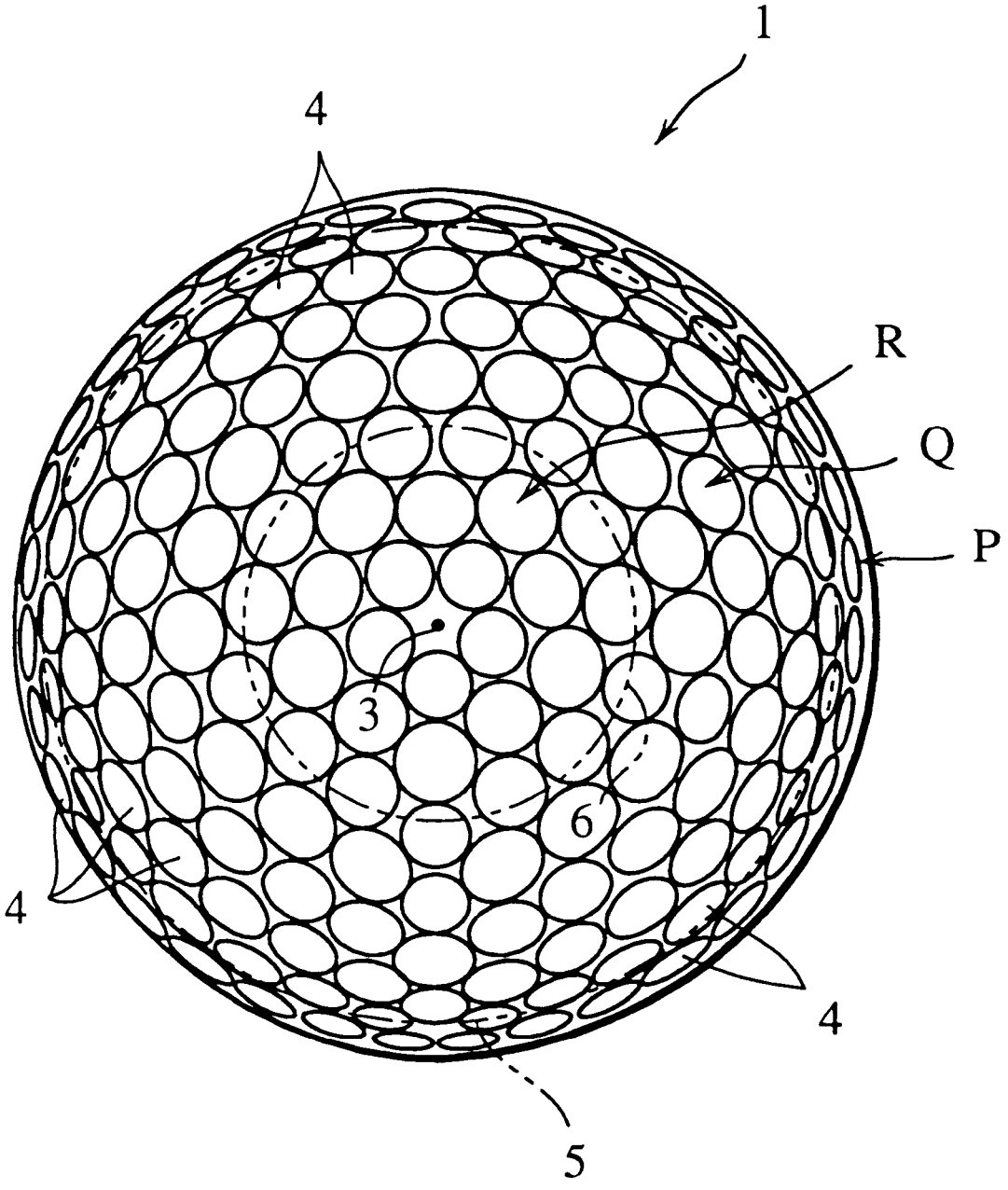
FIG. 2 is a plane view showing the preferred embodiment of the present invention.

FIG. 1 and FIG. 2 show a golf ball relating to the present invention. This golf ball 1 is a golf ball formed with a pair of half metal molds, 2 is a parting line (seam) corresponding to a contact face of the metal molds, 3 is a pole portion, and 4 is a circular dimple.

The parting line 2 represents latitude 0° , both of the pole portions 3 represent latitude 90° , an area from latitude 0° to latitude 17° is a parting line vicinity P, an area of which latitude is more than 17° and less than 62° is a shoulder portion Q, an area from latitude 62° to latitude 90° is a pole vicinity R. And, when total volume of the dimples 4 which belong to the parting line vicinity P is X, total volume of the dimples 4 which belong to the pole vicinity R is Y, total volume of the dimples 4 which belong to the shoulder portion Q is Z, X/Z is arranged to be 0.58 to 0.72 and Y/Z is arranged to be 0.22 to 0.30. And Y/X is arranged to be 0.35 to 0.48.

And, plural kinds of dimples 4 having different diameters are disposed on the shoulder portion Q. and at least one kind of dimples among the plural kinds of dimples 4, disposed on the shoulder portion Q, are disposed on the parting line vicinity P and the pole vicinity R. And, depths of the dimples 4 on the parting line vicinity P and the pole vicinity R are respectively set to be deeper than that of the dimples 4 of the same diameter (the same kind) belong to the shoulder portion Q for 0.003 mm to 0.06 mm.

Figure 3:
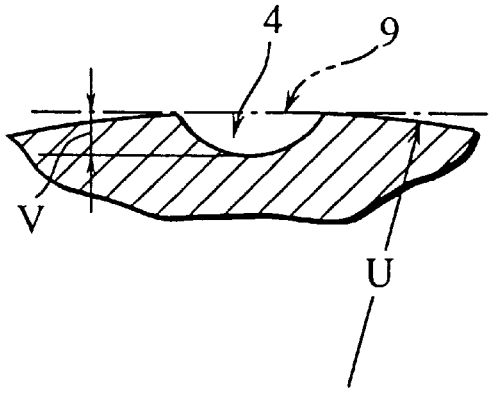
FIG. 3 is a cross-sectional view of an enlarged principal portion showing the preferred embodiment of the present invention.
Figure 4A:
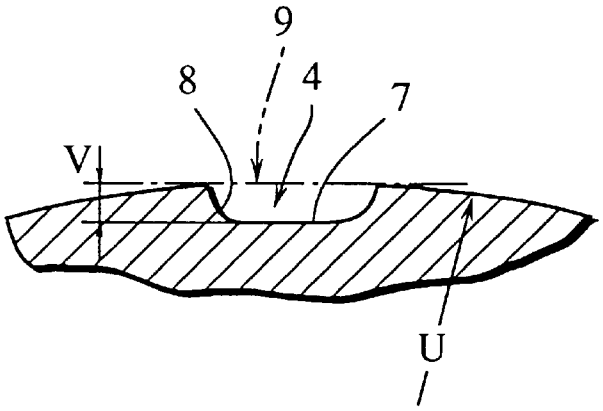
FIG. 4A is a cross-sectional view of an enlarged principal portion of another preferred embodiment.
Figure 4B:
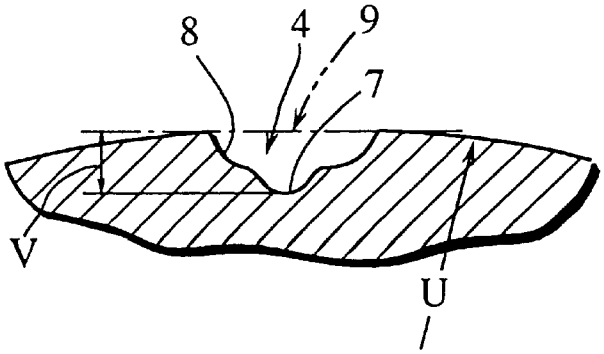
FIG. 4B is a cross-sectional view of an enlarged principal portion of another preferred embodiment.

In the present invention, as shown in FIG. 3, FIG. 4A. and FIG. 4B, a depth dimension V of the dimple 4 is defined as the shortest distance between a bottom portion of the dimple 4 and an imaginary plane 9 connecting edges of the dimple 4. Therefore, to describe the aforementioned depth setting of the dimple 4 in other words, a depth dimension V of the dimples 4, which belong to the parting line vicinity P and the pole vicinity R respectively, is arranged to be deeper than that of dimples 4 of the same kind belong to the shoulder portion Q for 0.003 mm to 0.06 mm.

Reason for this arrangement is that if the value is less than 0.003 mm, flying ability in pole-hitting and seam-hitting is hardly differs from that of conventional golf balls, and, if the value is over 0.06 mm, aerodynamic anisotropy becomes large for the dimple 4 set to be deep becomes extremely deep in comparison with the other dimples 4 of the same diameter, and flying ability disperses for the change of the hitting point.

And, (returning to FIG. 1 and FIG. 2,) the dimple 4 which belongs to the parting line vicinity P is a dimple 4 of which center is within a range from the parting line 2 to a first latitude line 5 of latitude $\theta_1$=17° . And, the dimple 4 which belongs to the pole vicinity R is a dimple 4 of which center is within a range from a second latitude line 6 of latitude $\theta_2$=62° to the pole portion 3. And, the dimple 4 which belongs to the shoulder portion Q is a dimple 4 within a range of which latitude is higher than the first latitude line 5 and lower than the second latitude line 6.

Relating to the meaning of the above-mentioned arrangement that $0.58 \leqq X/Z \leqq 0.72$, $0.22 \leqq Y/Z \leqq 0.30$, and $0.35 \leqq Y/X \leqq 0.48$, supplemental explanation is given as follows.

When $S_p$ represents a surface area of the parting line vicinity P of the golf ball, $S_q$ represents a surface area of the shoulder portion Q, and $S_r$ represents a surface area of the pole vicinity R, a relational formula $S_p:S_q:S_r$= 0.29237:0.59058:0.11705 is given according to a geometric calculation of the sphere divided with the (aforementioned) latitude $\theta_1$=17° and the latitudes $\theta_2$=62°.

Therefore, $S_p/S_q$=0.4951. If X/Z=0.4951, "average value of the volume of the dimple 4 in the parting line vicinity P" and "average value of the volume of the dimple 4 in the shoulder portion Q" are equal each other.

In the present invention, X/Z is arranged to be 0.58 to 0.72. This means "the average value of the volume of the dimple 4 in the parting line vicinity P is arranged to be larger than the average value of the volume of the dimple 4 in the shoulder portion Q".

Next, from the above formula ($S_p:S_q:S_r$), $S_r/S_q$=0.1982 is derived. If Y/Z=0.1982, "average value of the volume of the dimple 4 in the pole vicinity R" and "the average value of the volume of the dimple 4 in the shoulder portion Q" are equal each other.

In the present invention, Y/Z is arranged to be 0.22 to 0.30. This means "the average value of the volume of the dimple 4 in the pole vicinity R is arranged to be larger than the average value of the volume of the dimple 4 in the shoulder portion Q".

Next, from the above formula ($S_p:S_q:S_r$), $S_r/S_p$=0.4003 is derived. If Y/X=0.4003, "the average value of the volume of the dimple 4 in the parting line vicinity P" and "the average value of the volume of the dimple 4 in the pole vicinity R" are equal each other.

In the present invention, Y/X is arranged to be 0.35 to 0.48. This means "the average value of the volume of the dimple 4 in the pole vicinity R is arranged to be (approximately) equal to the average value of the volume of the dimple 4 in the parting line vicinity P".

Next, as shown in FIG. 3, cross-sectional shape of the dimple 4 at a diameter portion is made to be an arc, or, as shown in FIG. 4A and FIG. 4B, a combination of two different arcs of a bottom portion 7 and a remaining portion 8. The cross-sectional shape of the dimple 4 at the diameter portion may be different from these shapes.

And, a volume of a hollow portion surrounded by the above-mentioned imaginary plane 9 and an inner face of the dimple 4 is volume of one dimple 4 itself. That is to say, the total volume X is sum of volume of the dimples 4 which belong to the parting line vicinity P, the total volume Y is sum of volume of the dimples 4 which belong to the pole vicinity R, and the total volume Z is sum of volume of the dimples 4 which belong to the shoulder portion Q.

Therefore, with the composition as described above, the total volume Y of the dimples 4 in the pole vicinity R becomes large in comparison with a case that dimples of same depth are uniformly disposed on the whole surface of the ball, and trajectory in pole-hitting becomes low. And, the total volume X of the dimples 4 in the parting line vicinity P becomes large, and trajectory in seam-hitting becomes high thereby. And, synergistic effect of the two makes the trajectory in pole-hitting and the trajectory of seam-hitting approximately same.

Figure 6:
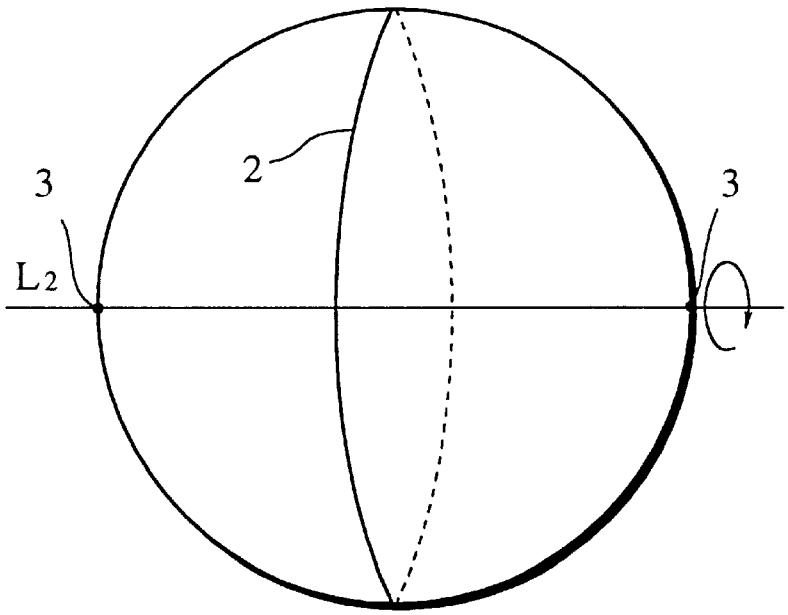
FIG. 6 is an explanatory view of hitting method.

X/Z is arranged to be 0.58 to 0.72 in the present invention. Because when X/Z is lower than 0.58, trajectory raising effect becomes insufficient in hitting with a hitting method in which an axis $L_2$ going through both of the poles 3 is a rotational axis (seam-hitting) as shown in FIG. 6, and when X/Z is over 0.72, the dimples 4 which belong to the parting line vicinity P become extremely deep in comparison with other dimples, and aerodynamic anisotropy becomes large thereby.

Figure 5:
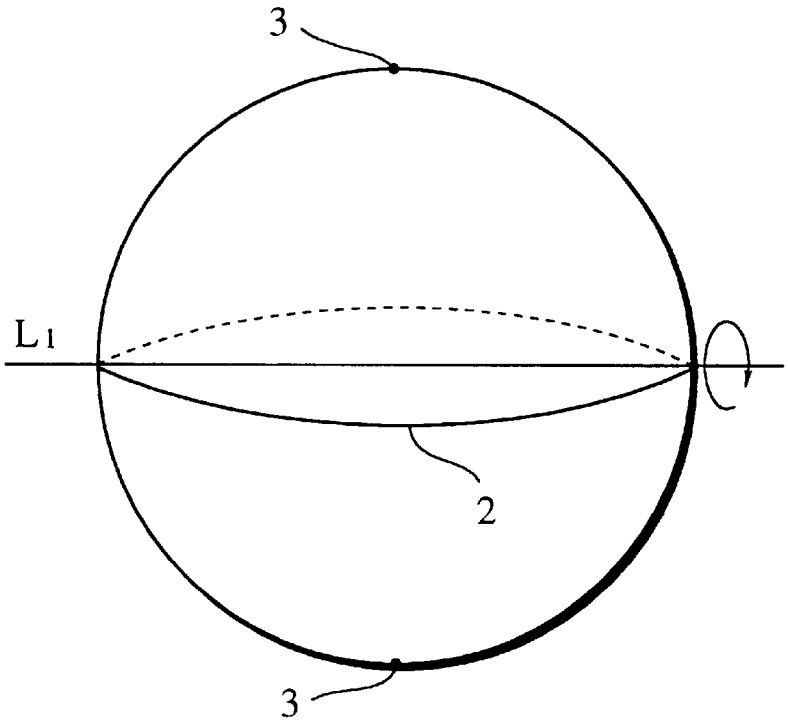
FIG. 5 is an explanatory view of hitting method.

And, Y/Z is arranged to be 0.22 to 0.30, because when Y/Z is lower than 0.22, trajectory lowering effect becomes insufficient in hitting with a hitting method in which an axis $L_1$ going through the parting line is a rotational axis of back spin (pole-hitting) as shown in FIG. 5, and when Y/Z is over 0.30, the dimples 4 which belong to the pole vicinity R become extremely deep in comparison with other dimples, and aerodynamic anisotropy becomes large thereby.

Y/X is arranged to be 0.35 to 0.48, because when Y/X is lower than 0.35, trajectory lowering effect becomes insufficient in pole-hitting, and when Y/X is over 0.48, the dimples 4 which belong to the pole vicinity R become extremely deep in comparison with other dimples, and aerodynamic anisotropy becomes large thereby. Supplemental explanation on the above-described points is given as follows.

Meaning of making the total volume X of the dimples in the parting line vicinity P large X in the parting line vicinity P becomes small with uniform dimple disposition, and trajectory in seam-hitting becomes low.

Dimples can not be disposed on the parting line, and dimples near the parting line are ground in flash-removal, and dimple effect is weakened. Although lowering the trajectory in seam-hitting is prevented by deepening dimples near the parting line conventionally, the trajectory is still lower than that in pole-hitting, difference of flying ability is generated by difference of hitting points.

Therefore, in the present invention, trajectory in seam-hitting is raised by X/Z arranged to be more than 0.58.

Meaning of making the total volume Y of the dimples in the pole vicinity R large Although lowering the trajectory in seam-hitting is prevented as described above, the trajectory is still lower than that in pole-hitting. So the inventor of the present invention thought of eliminating the difference of the trajectory between pole-hitting and seam-hitting by lowering the trajectory in pole-hitting. When the total volume Y in the pole vicinity R is larger than that of uniform dimple disposition, the trajectory in pole-hitting becomes low. Therefore, the trajectory in pole-hitting is lowered by arranging Y/Z to be more than 0.22 in the present invention. Then, it is expected that the trajectories of pole-hitting and seam-hitting are made to be approximately same by synergistic effect of the prevention of lowering the trajectory in seam-hitting and the lowering of the trajectory in pole-hitting.

Thinkable reason, why the trajectories in pole-hitting and seam-hitting are different despite deepening the dimples in both of the pole vicinity R and the parting line vicinity P, is as follows.

Enlarging the total volume X of the dimples in the parting line vicinity P is based on an idea that trajectory of a golf ball having dimples is higher than that of a golf ball of smooth surface without dimples, so the trajectory of the golf ball is raised by enlarging the total volume X of the dimples in the parting line vicinity P where the dimples are ground when flash is removed. On the other hand, enlarging the total volume Y of the dimples in the pole vicinity R is based on an idea that trajectory of a golf ball is lowered by deepening the dimples in the pole vicinity R.

That is to say:

(a) Trajectory in pole-hitting becomes low when the total volume Y of the pole vicinity R is larger than that in a uniform dimple disposition. In the present invention, Y/Z is arranged to be more than 0.22, and the trajectory in pole-hitting becomes low thereby.

(b) Trajectory in seam-hitting becomes high when the total volume X of the parting line vicinity P is larger than that in a uniform dimple disposition. In the present invention, X/Z is arranged to be more than 0.58, and the trajectory in seam-hitting becomes high thereby.

In the present invention, not restricted to the embodiments described above, for example, dimples 4 having same diameter may be disposed on the whole surface of the golf ball, and the dimples 4 which belong to the parting line vicinity P and depth of the dimples 4 which belong to the pole vicinity R may be arranged to be deeper than that of the dimples 4 which belong to the shoulder portion Q for 0.003 mm to 0.06 mm.

EXAMPLES

A golf ball of an example of the present invention and golf balls of comparison examples 1 through 4 were actually made. In the golf balls of the example and the comparison examples 1 through 4, plural kinds of dimples having different diameter and depth shown in table 1 are disposed on positions as shown in table 2, dimple disposition patterns of the both pole sides are symmetric with respect to the parting line, and the total volume X in the parting line vicinity, the total volume Y in the pole vicinity, the total volume Z in the shoulder portion, X/Z, Y/Z, and Y/X are set as shown in table 3. And, in table 3, values of the total volume X, Y, and Z are shown with values of a hemisphere of the golf ball.

TABLE 1

| DIMPLE | | DIAMETER (mm) | DEPTH (mm) | VOLUME ($mm^2$) |
|---|---|---|---|---|
| A | A1 | 4.29 | 0.170 | 1.23121 |
| | A2 | 4.29 | 0.145 | 1.04955 |
| | A3 | 4.29 | 0.125 | 0.904431 |
| B | B1 | 3.87 | 0.147 | 0.86623 |
| | B2 | 3.87 | 0.130 | 0.765734 |
| | B3 | 3.87 | 0.115 | 0.677158 |
| C | C1 | 3.47 | 0.141 | 0.668179 |
| | C2 | 3.47 | 0.128 | 0.606339 |
| | C3 | 3.47 | 0.107 | 0.506585 |
| D | D1 | 3.26 | 0.130 | 0.543698 |
| | D2 | 3.26 | 0.121 | 0.505914 |
| | D3 | 3.26 | 0.101 | 0.422057 |

TABLE 2

| DIMPLE | PORTION | LATITUDE (°) | LONGITUDE (°) | | | | |
|---|---|---|---|---|---|---|---|
| A | SHOULDER PORTION | 38.376 | 0.000 | 72.000 | 144.000 | 216.000 | 288.000 |
| | | 53.616 | 15.658 | 56.342 | 87.658 | 128.342 | 159.658 |
| | | 53.616 | 200.342 | 231.658 | 272.342 | 303.658 | 344.342 |
| | | 54.884 | 36.000 | 108.000 | 180.000 | 252.000 | 324.000 |
| | POLE VICINITY | 70.8 | 0.000 | 72.000 | 144.000 | 216.000 | 288.000 |
| B | PARTING LINE VICINITY | 5.64 | 10.200 | 30.625 | 41.375 | 61.800 | 82.200 |
| | | 5.64 | 102.625 | 113.375 | 133.800 | 154.200 | 174.625 |
| | | 5.64 | 185.375 | 205.800 | 226.200 | 246.625 | 257.375 |
| | | 5.64 | 277.800 | 298.200 | 318.625 | 329.375 | 349.800 |
| | | 15 | 36.000 | 108.000 | 180.000 | 252.000 | 324.000 |
| | | 15.019 | 15.187 | 56.813 | 87.187 | 128.813 | 159.187 |
| | | 15.019 | 200.813 | 231.187 | 272.813 | 303.187 | 344.813 |
| | SHOULDER PORTION | 23.992 | 29.956 | 42.044 | 101.956 | 114.044 | 173.956 |
| | | 23.992 | 186.044 | 245.956 | 258.044 | 317.956 | 330.044 |
| | | 31.562 | 10.692 | 61.308 | 82.692 | 133.308 | 154.692 |
| | | 31.562 | 205.308 | 226.692 | 277.308 | 298.692 | 349.308 |
| | | 34.293 | 23.041 | 48.959 | 95.041 | 120.959 | 167.041 |
| | | 34.293 | 192.959 | 239.041 | 264.959 | 311.041 | 336.959 |
| | | 34.465 | 36.000 | 108.000 | 180.000 | 252.000 | 324.000 |
| | | 42.62 | 13.510 | 58.490 | 85.510 | 130.490 | 157.510 |
| | | 42.62 | 202.490 | 229.510 | 274.490 | 301.510 | 346.490 |
| | | 44.782 | 28.145 | 43.855 | 100.145 | 115.855 | 172.145 |
| | | 44.782 | 187.855 | 244.145 | 259.855 | 316.145 | 331.855 |
| | POLE VICINITY | 64.106 | 23.690 | 48.310 | 95.690 | 120.310 | 167.690 |
| | | 64.106 | 192.310 | 239.690 | 264.310 | 311.690 | 336.310 |
| | | 74.15 | 36.000 | 108.000 | 180.000 | 252.000 | 324.000 |
| C | PARTING LINE VICINITY | 5.103 | 0.000 | 20.395 | 51.605 | 72.000 | 92.395 |
| | | 5.103 | 123.605 | 144.000 | 164.395 | 195.605 | 216.000 |
| | | 5.103 | 236.395 | 267.605 | 288.000 | 308.395 | 339.605 |
| | | 14.392 | 25.615 | 46.385 | 97.615 | 118.385 | 169.615 |
| | | 14.392 | 190.385 | 241.615 | 262.385 | 313.615 | 334.385 |
| | SHOULDER PORTION | 24.545 | 18.962 | 53.038 | 90.962 | 125.038 | 162.962 |
| | | 24.545 | 197.038 | 234.962 | 269.038 | 306.962 | 341.038 |
| | | 27.704 | 0.000 | 72.000 | 144.000 | 216.000 | 288.000 |
| | | 49.089 | 0.000 | 72.000 | 144.000 | 216.000 | 288.000 |
| | | 60.133 | 0.000 | 72.000 | 144.000 | 216.000 | 288.000 |
| | POLE VICINITY | 81.88 | 0.000 | 72.000 | 144.000 | 216.000 | 288.000 |
| D | PARTING LINE VICINITY | 13.73 | 4.620 | 67.380 | 76.620 | 139.380 | 148.620 |
| | | 13.73 | 211.380 | 220.620 | 283.380 | 292.620 | 355.380 |
| | SHOULDER PORTION | 22.02 | 8.042 | 63.958 | 80.042 | 135.958 | 152.042 |
| | | 22.02 | 207.958 | 224.042 | 279.958 | 296.042 | 351.958 |

TABLE 3

| | EXAMPLE | COMPARISON EXAMPLE 1 | COMPARISON EXAMPLE 2 | COMPARISON EXAMPLE 3 | COMPARISON EXAMPLE 4 |
|---|---|---|---|---|---|
| TOTAL VOLUME IN PARTING LINE VICINITY (X) ($mm^3$) | 52.45 | 52.45 | 40.59 | 40.59 | 47.02 |
| TOTAL VOLUME IN POLE VICINITY (Y) ($mm^3$) | 22.49 | 17.21 | 22.49 | 17.21 | 19.77 |
| TOTAL VOLUME IN SHOULDER PORTION (Z) ($mm^3$) | 83.34 | 83.34 | 83.34 | 83.34 | 83.34 |
| X/Z | 0.63 | 0.63 | 0.49 | 0.49 | 0.56 |
| Y/Z | 0.27 | 0.21 | 0.27 | 0.21 | 0.24 |
| Y/X | 0.43 | 0.33 | 0.55 | 0.42 | 0.42 |
| DIMPLES IN PARTING LINE VICINITY | B1, C1, D1 | B1, C1, D1 | B3, C3, D3 | B3, C3, D3 | B2, C2, D2 |
| DIMPLES IN POLE VICINITY | A1, B1, C1 | A3, B3, C3 | A1, B1, C1 | A3, B3, C3 | A2, B2, C2 |
| DIMPLES IN SHOULDER PORTION | A2, B2 C2, D2 | A2, B2 C2, D2 | A2, B2 C2, D2 | A2, B2 C2, D2 | A2, B2 C2, D2 |

As clearly shown in the above table 3, the example has values of X/Z, Y/Z, Y/X within the range defined in the present invention. To the contrary, the comparison example 1 has-values of Y/Z and Y/X smaller than the defined range. The comparison example 2 has X/Z smaller than the defined range and Y/X larger than the defined range. The comparison example 3 has values of X/Z and Y/Z smaller than the defined range. And the comparison example 4 has value of X/Z smaller than the defined range.

The above golf balls of the example and the comparison examples are hitted by a No. 1 wood (driver) with a head-speed of 45 m/s in windless condition. And, carry, elevation angle of trajectory, and flight time are measured. The result is shown in table 4 below.

According to the golf ball of the present invention, aerodynamic anisotropy is eliminated, flying ability in pole-hitting and flying ability in seam-hitting become approximately same. Therefore, flying ability is stable without dispersion when the golf ball is hitted at any position on the surface of the golf ball.

And, according to the golf ball of the present invention, in a golf ball on which plural kinds of dimples 4 having different diameter are disposed, flying ability becomes stable without dispersion when the golf ball is hitted at any position on the surface of the golf ball.

Further, in a golf ball that dimples having same diameter are disposed on the whole surface of the golf ball, flying ability becomes stable without dispersion when the golf ball is hitted at any position on the surface of the golf ball.

TABLE 4

| | | CARRY (m) | ELEVATION ANGLE (°) | FLIGHT TIME (S) |
|---|---|---|---|---|
| EXAMPLE | POLE-HITTING | 230.5 | 12.31 | 6.03 |
| | SEAM-HITTING | 230.6 | 12.33 | 6.03 |
| | ABSOLUTE VALUE OF DIFFERENCE | 0.1 | 0.02 | 0.00 |
| COMPARISON EXAMPLE 1 | POLE-HITTING | 229.5 | 12.52 | 6.06 |
| | SEAM-HITTING | 230.6 | 12.35 | 6.03 |
| | ABSOLUTE VALUE OF DIFFERENCE | 1.1 | 0.17 | 0.03 |
| COMPARISON EXAMPLE 2 | POLE-HITTING | 230.0 | 12.28 | 6.03 |
| | SEAM-HITTING | 227.8 | 12.08 | 5.95 |
| | ABSOLUTE VALUE OF DIFFERENCE | 2.2 | 0.20 | 0.08 |
| COMPARISON EXAMPLE 3 | POLE-HITTING | 230.2 | 12.47 | 6.05 |
| | SEAM-HITTING | 228.1 | 12.10 | 5.99 |
| | ABSOLUTE VALUE OF DIFFERENCE | 2.1 | 0.37 | 0.06 |
| COMPARISON EXAMPLE 4 | POLE-HITTING | 230.4 | 12.38 | 6.04 |
| | SEAM-HITTING | 229.2 | 12.23 | 6.01 |
| | ABSOLUTE VALUE OF DIFFERENCE | 1.2 | 0.15 | 0.03 |

As clearly shown in the above table 4, in the example, comparing the pole-hitting with the seam-hitting, absolute value of difference is small in carry, elevation angle of trajectory, and flight time, so the pole-hitting and the seam-hitting hardly differ in flying ability. On the contrary, in the comparison examples 1 through 4, absolute value of difference is large in comparison with the example in carry, elevation angle of trajectory, and flight time, and dispersion of flying ability in the pole-hitting and the seam-hitting is large.

While preferred embodiments of the present invention have been described in this specification, it is to be understood that the invention is illustrative and not restrictive, because various changes are possible within the spirit and the indispensable features.

What is claimed is:

1. A golf ball formed by half metal molds comprising an arrangement in which:

a parting line is latitude 0° and both poles are latitude 90°;

a range of which latitude is 0° to 17° is a parting line vicinity, a range of which latitude is more than 17° and less than 62° is a shoulder portion, and a range of which latitude is 62° to 90 ° is a pole vicinity; and when X represents total volume of dimples which belong to the parting line vicinity, Y represents total volume of dimples which belong to the pole vicinity, and Z represents total volume of dimples which belong to the shoulder portion, a ratio of is set to be 0.58 to 0.72, and a ratio of is set to be 0.22 to 0.30.

2. The golf ball as set forth in claim 1, wherein a ratio of Y/X is set to be 0.35 to 0.48.

3. A golf ball formed by half metal molds comprising an arrangement in which:

a parting line is latitude 0° and both poles are latitude 90°;

a range of which latitude is 0° to 17° is a parting line vicinity, a range of which latitude is more than 17° and less than 62° is a shoulder portion, and a range of which latitude is 62° to 90 ° is a pole vicinity;

plural kinds of dimples having different diameter are disposed on the shoulder portion, and at least one kind of dimples among the plural kinds of dimples disposed on the shoulder portion are disposed on the parting line vicinity and the pole vicinity; and depths of the dimples which belong to the parting line vicinity and the pole vicinity are respectively arranged to be deeper than that of the dimples of same diameter which belong to the shoulder portion by 0.003 mm to 0.06 mm.

4. A golf ball formed by half metal molds comprising an arrangement in which:

a parting line is latitude 0° and both poles are latitude 90°;

a range of which latitude is 0° to 17° is a parting line vicinity, a range of which latitude is more than 17° and less than 62° is a shoulder portion, and a range of which latitude is 62° to 90 ° is a pole vicinity; and dimples having same diameter are disposed on the whole surface of the golf ball, and depths of the dimples which belong to the parting line vicinity and the pole vicinity are respectively arranged to be deeper than that of the dimples which belong to the shoulder portion by 0.003 mm to 0.06 mm.

* * * * *